United States Patent [19]

Bengtsson

[11] 4,131,976

[45] Jan. 2, 1979

[54] BUCKLE

[76] Inventor: Sigurd W. Bengtsson, Bruksgatan 17, 414 51 Gotenborg, Sweden

[21] Appl. No.: 740,433

[22] Filed: Nov. 10, 1976

[30] Foreign Application Priority Data

Nov. 17, 1975 [SE] Sweden ..... 75128751

[51] Int. Cl.[2] ..... A44B 11/10

[52] U.S. Cl. ..... 24/196

[58] Field of Search ..... 24/196, 171, 194, 190

[56] References Cited

U.S. PATENT DOCUMENTS

| | | | |
|---|---|---|---|
| 1,481,025 | 1/1924 | Prentice | 24/196 |
| 3,121,272 | 2/1964 | Matthews | 24/196 |
| 3,163,905 | 9/1962 | Gaylord | 24/196 |
| 3,377,667 | 4/1968 | Alofs | 24/196 |
| 3,390,436 | 7/1968 | Prete | 24/196 |
| 3,928,895 | 12/1975 | Klink | 24/196 |
| 4,035,877 | 7/1977 | Brownson | 24/171 |

FOREIGN PATENT DOCUMENTS

| | | | |
|---|---|---|---|
| 467052 | 6/1937 | United Kingdom | 24/196 |

*Primary Examiner*—Bernard A. Gelak

*Attorney, Agent, or Firm*—Hill, Gross, Simpson, Van Santen, Steadman, Chiara & Simpson

[57] ABSTRACT

A buckle includes an open rectangular frame having a passage lying in the plane of the frame, together with a locking washer slidably disposed in the passage. Means are provided, in the form of complemental construction on the frame and washer, preventing the locking washer from falling out of the frame at least in one direction. One strap end can be secured to one transverse portion of the frame, while another strap end can be directed through the opening in the frame, around one side of the locking washer, and back through the same opening. The other side of the locking washer can extend through the other side of the frame.

2 Claims, 5 Drawing Figures

BUCKLE

BACKGROUND OF THE INVENTION

1. Field of the Invention

This invention is directed to a buckle.

2. Prior Art

A typical belt buckle has a pivoted pin that is adapted to extend through one of a series of openings provided in the band, such as a strap or a belt. Another typical buckle requires the use of two hands for adjusting its position to a tighter or a looser position. Other typical belt buckles, in order to be assembled as a buckle, require some type of metal forming. Further, some types of buckle are difficult to tighten or release if the person involved is wearing gloves or mittens.

SUMMARY OF THE INVENTION

According to the present invention, an open rectangular frame has a passage lying in the plane of the frame, in which another open rectangular member, herein referred to as a locking washer, is slidably disposed. One end of a band can be secured to an end of the frame, and another band end can extend through the frame remotely from the washer opening, and thence again through the frame through both of the openings in the frame and locking washer, the other side of the locking washer being in the frame passage and projecting therefrom.

Accordingly, it is an object of the present invention to provide a buckle that can be tightened or loosened using only one hand.

Further, it is an object of this invention to provide a buckle that can be actuated by a hand having a glove or mitten.

A further object of the present invention is to provide a buckle construction in which the components fit together because of their own configuration, without there being any need for metal forming, welding, riveting or the like.

Many other advantages, features and additional objects of the present invention will become a manifest to those versed in the art upon making reference to the detailed description and the accompanying sheet of drawings in which a preferred structural embodiment incorporating the principles of the present invention is shown by way of illustrative example.

ON THE DRAWING

AS SHOWN ON THE DRAWING

Figure 1:
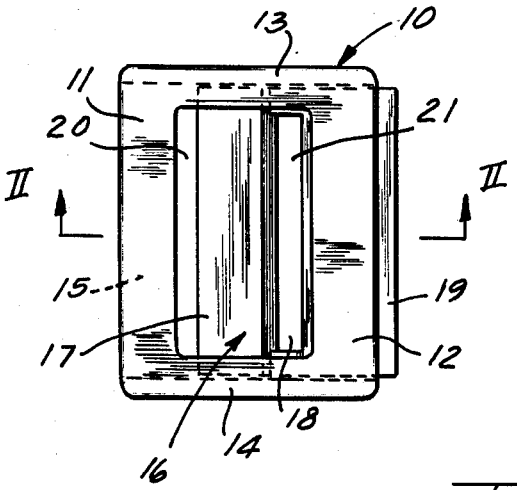
FIG. 1 is a plan view of a first embodiment of the buckle.

The buckle comprises a frame 10 and a locking washer 16. The frame 10 is quadrilateral and thus is an open rectangle which comprises two transverse side members 11,12 and two longitudinal side members 13,14. Within the frame 10, there is a passage extending in a centrally located plane from the external edge of one transverse side member 11 to the external edge of the opposite transverse side member 12. The thickness of the passage in the transverse side member 12 is reduced as explained below.

The locking washer 16 is slidably guided and is displaceable in the longitudinal direction of the passage 15. Guidance is provided by channel shaped portions in the longitudinal side members 13,14 of the frame 10. The washer 16 includes a portion referred to herein as a cross-member 17, a transverse opening 18 adjacent thereto, and an opposite portion referred to herein as a tongue-shaped extension 19 of reduced thickness joined at its ends to the cross-member 17. When the locking washer 16 has been introduced into the passage 15, (from the left as shown on the drawing), the cross-member 17 will subdivide the space between the side members 13,14 of the frame 10 into two openings 20,21, respectively. The opening 21 will substantially mate with the opening 18 in the locking washer 16.

The locking washer 16 has such an extent, in the direction of displacement, that the tongue-shaped extension 19 will extend beyond the second transverse side member 12 of the frame 10 when the cross-member 17 has been displaced toward the side member 12, so that the distance between the side member 12 and the cross-member 17 substantially corresponds to the thickness of the band to be used with the buckle.

Figure 3:
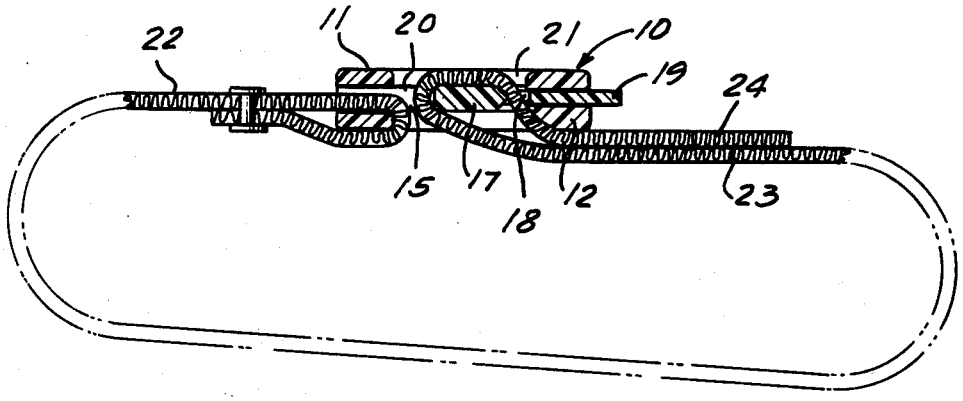
FIG. 3 is a repetition of FIG. 2, but fitted with a band.

FIG. 3 shows the buckle 10 with a band attached thereto. A first band end 22 is permanently attached to the buckle at the first of its transverse side members 11, for instance by its end 22 being introduced into the passage 15 and then being folded backward around one-half of the transverse side member 11, and being riveted or sewn to its own main portion. The permanent attachment of the band 22 prevents removal of the locking washer 16.

A free portion 24 of the other end 23 of the band is introduced from below, namely from the lower side, through the opening 20, and is passed over the cross-member 17 and down through the openings 21,18.

A pulling on the band end 23 in the plane of the buckle will initially press the free end portion 24 of the band against the second transverse side member 12. With further pulling, locking is brought about since cross-member 17 is simultaneously moved toward the side member 12, thereby effectively locking the band end. The edge of the cross-member 17 which faces toward the side member 12 is comparatively sharp and may be serrated, but not to such a degree as to cause any damage to the material of the band.

Under this condition, the tongue 19 projects outwardly from the frame. The tongue 19 can be pushed inwardly by one finger or a portion of a hand, and using other digits of the same hand, the band can be tightened or loosened by a light pulling on the band portion 24 or the band portion 23, respectively, to obtain the desired adjusted size. With the tongue 19 released, by pulling on either portion 24 or 23, the buckle is placed in the locking position.

As mentioned briefly above, the locking washer 16 is introduced into the passage 15 through the side member 11, and thereafter is retained in the frame 10 by the permanent attachment of the band end 22. To obtain this result, the passage 15 has a uniform height from its entrance end in the side member 11 to the side member 12, and has a somewhat reduced height within the side member 12. The part of the locking washer 16 including the cross-member 17 has a substantially uniform thickness corresponding to the height of the main portion of the passage 15, while the tongue-shaped extension 19 has substantially the same thickness as the height of the passage within the side member 12. By such structure, the locking washer 16 cannot be pulled out of the frame 10.

The frame 10 and the locking washer 16 are preferably made of synthetic resin. The side member 12 is undercut or bevelled at an edge 25 facing the emerging band end 24 to avoid or minimize any tendency of the buckle to raise from the common plane including both band ends 23,24.

The embodiments of the invention disclosed herein are suitable for use as part of strap assemblies adapted to latch together skiing equipment. A more rugged embodiment of the buckle is suitable for mountaineering equipment, where on many occasions, it is vital to be able to tighten or to loosen a buckle with only one hand.

Figure 2:
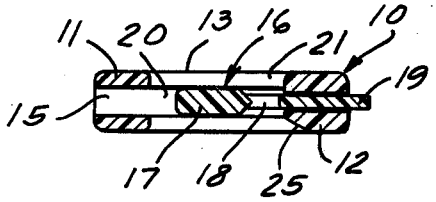
FIG. 2 is a longitudinal cross-sectional view taken along line II—II of FIG. 1.
Figure 4:
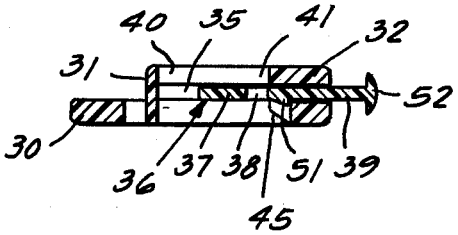
FIG. 4 is a view corresponding to FIG. 2 of a modified embodiment.

A modified embodiment is shown in FIG. 4. It includes a passage 35, corresponding to the passage 15, which extends from a side member 31, located near the left end of the buckle as shown in the drawing, without passing through said side member 31, to and through the right transverse side member 32. For the attachment of the first band end 22, there is a bar 30 on the frame spaced from the side member 31. The passage 35 has a uniform height. A locking washer 36 has a cross-member 37, an opening 38 and a tongue-shaped extension 39, but is here adapted to be introduced through the right frame member 32. To prevent removal of the locking washer 36, there is a wedge-shaped projection at one of its side faces. The materials of the frame and of the washer are here selected so as to provide an elastic deformation sufficient to permit the introduction of a projection 51 through the portion of the passage 35 lying within the side member 32. The projection 51 will snap out into the opening 41, and will thereafter limit the movement of the washer 36 in an outward direction. The projection 51 has a limited horizontal extent along the passage 35, and a lower portion of the side member 32 has an inner edge with a recess adapted to receive the projection 51. This inner edge is undercut at 45 as at 25 in the embodiment of FIG. 2. The outer edge of the tongue 39 of the washer 36 is provided with a flange 52 to facilitate the inward pushing of the washer.

Figure 5:
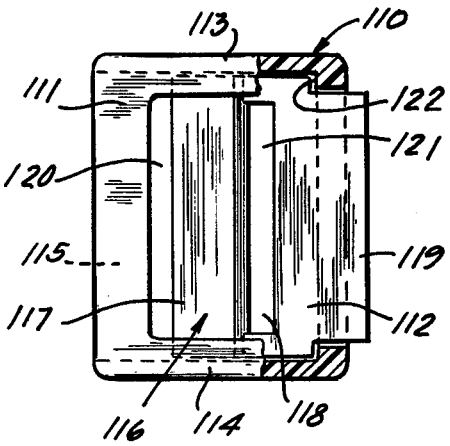
FIG. 5 is a plan view corresponding to FIG. 1 of a further embodiment.

A further modified embodiment is shown in FIG. 5 in which a value of 100 has been added to reference numerals relating to corresponding elements in FIG. 1. The locking washer 116 can be manufactured of metal and has a uniform thickness. The passage 115 has a uniform height all along its length. To prevent removal of the locking washer 116, the passage 115 has a reduced width within the side member 112, the tongue-shaped extension 119 likewise having a reduced width compared to the portion of the washer 116 having the cross-member 117. The wider portion can engage a shoulder 122 formed by the reduction of the width of the passage 115.

It is not necessary that the band ends 22,23 be opposite ends of the same band. The ends can be attached to different objects, or to various portions of the same object.

The invention is especially suited to be used with woven bands of synthetic fibers, where it is undesirable to punch holes for the pin of a buckle of the ordinary type. The term "band" as used herein is not to be understood as implying any limitation as to size or material.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A buckle comprising:

(a) a generally annular frame including a pair of opposite side members and a pair of opposite transverse members jointly defining a single first opening bounded thereby, there being a frame passage in the plane of the frame extending through only one of said transverse members and said opening in parallel with the length of said side members; and (b) a locking washer slidably disposed in said passage, said washer having a cross-member and a tongue-shaped extension defining opposite portions of said washer with a second opening therebetween, said cross-member dividing said single first opening into a pair of band-receptive passages therethrough, said cross-member and said second opening having a combined extent less than that of the length of said side members, said tongue-shaped extension being extendable through said one transverse member, said locking washer having a wedge-shaped projection on said extension enabling said one transverse member to be temporarily deformed for receiving said projection into said first opening and for thereafter precluding removal of said locking washer from said frame.

2. A buckle comprising:

(a) a generally annular frame including a pair of opposite side members and a pair of opposite transverse members jointly defining a single first opening bounded thereby, there being a frame passage in the plane of the frame extending through at least one of said transverse members and said opening in parallel with the length of said side members; and (b) a locking washer slidably disposed in said passage, said washer having a cross-member and a tongue-shaped extension defining opposite portions of said washer with a second opening therebetween, said cross-member dividing said single first opening into a pair of band-receptive passages therethrough, said cross-member and said second opening having a combined extent less than that of the length of said side members, said tongue-shaped extension being extendable through said one transverse member, said tongue-shaped extension and a portion of said frame passage lying in said one transverse member respectively having lesser thicknesses in a direction normal to that of the sliding of the locking washer, than said cross-member.

* * * * *